US007883377B2

(12) United States Patent
Cheng

(10) Patent No.: US 7,883,377 B2
(45) Date of Patent: Feb. 8, 2011

(54) CABLE ASSEMBLY WITH IMPROVED HOUSING

(75) Inventor: Yung-Chang Cheng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/635,714

(22) Filed: Dec. 11, 2009

(65) Prior Publication Data

US 2010/0151745 A1 Jun. 17, 2010

(30) Foreign Application Priority Data

Dec. 11, 2008 (CN) ..... 2008 1 0306154

(51) Int. Cl.
*H01R 13/405* (2006.01)

(52) U.S. Cl. ..... 439/736; 439/869

(58) Field of Classification Search ..... 439/736, 439/869

See application file for complete search history.

(56) References Cited

U.S. PATENT DOCUMENTS

| | | | | |
|---|---|---|---|---|
| 4,092,058 | A * | 5/1978 | Eigenbrode | 439/709 |
| 5,590,463 | A * | 1/1997 | Feldman et al. | 29/844 |
| 5,997,340 | A * | 12/1999 | Ito et al. | 439/460 |
| 2010/0151745 | A1 * | 6/2010 | Cheng | 439/676 |

* cited by examiner

*Primary Examiner*—James Harvey
(74) *Attorney, Agent, or Firm*—Wei Te Chung; Andrew C. Cheng; Ming Chieh Chang

(57) ABSTRACT

An electric connector includes a housing with a plurality of receiving grooves separated by a plurality of ribs, and a plurality of terminals which each has a rear edge received in one of the receiving grooves. Each of the rib includes a pair of wings formed by hot melting a protrusion defined on a tail of the rib. Each two wings received in the same receiving groove block one rear edge of the terminals.

20 Claims, 6 Drawing Sheets

CABLE ASSEMBLY WITH IMPROVED HOUSING

BACKGROUND OF THE INVENTION

1. Field of the Invention

The present invention relates generally to a cable assembly, and more particularly to a cable assembly with improved housing.

2. Description of Prior Art

A cable assembly is a type of necessary components inner an electric device. A cable assembly assembled with twisted-pair cables for high impedance requirement is sometimes used to connect a Liquid Crystal Display (LCD) and a main board in the electric device. The cable assembly always comprises a housing and a plurality of terminals received in the housing for connected to the twisted-pair cables. Each of the twisted-pair cable includes two wires winded together which would give a pull on the joint of the terminal and the wires. Thus, the terminal connected to the twisted-pair wires needs to be fastened on the connector firmly, or else the terminal will be broken away from the cable assembly. Thus, a normal housing does not fit to receive the terminals connected to the twisted-pair cables.

Hence, in this art, a cable assembly to overcome the above-mentioned disadvantages of the prior art should be provided.

SUMMARY OF THE INVENTION

An object of the present invention is to provide an electric connector with an improved housing for providing a retentivity between an terminal and the housing.

To achieve the aforementioned object, the present invention provides an electric connector comprises a housing with a plurality of receiving grooves separated by a plurality of ribs, and a plurality of terminals which each has a rear edge received in one of the receiving grooves. Each of the rib comprises a pair of wings formed by hot melting a protrusion defined on a tail of the rib. Each two wings received in the same receiving groove block one rear edge of the terminals.

Additional novel features and advantages of the present invention will become apparent by reference to the following detailed description when taken in conjunction with the accompanying drawings.

DETAILED DESCRIPTION OF THE INVENTION

Reference will now be made in detail to the preferred embodiment of the present invention.

Figure 1:
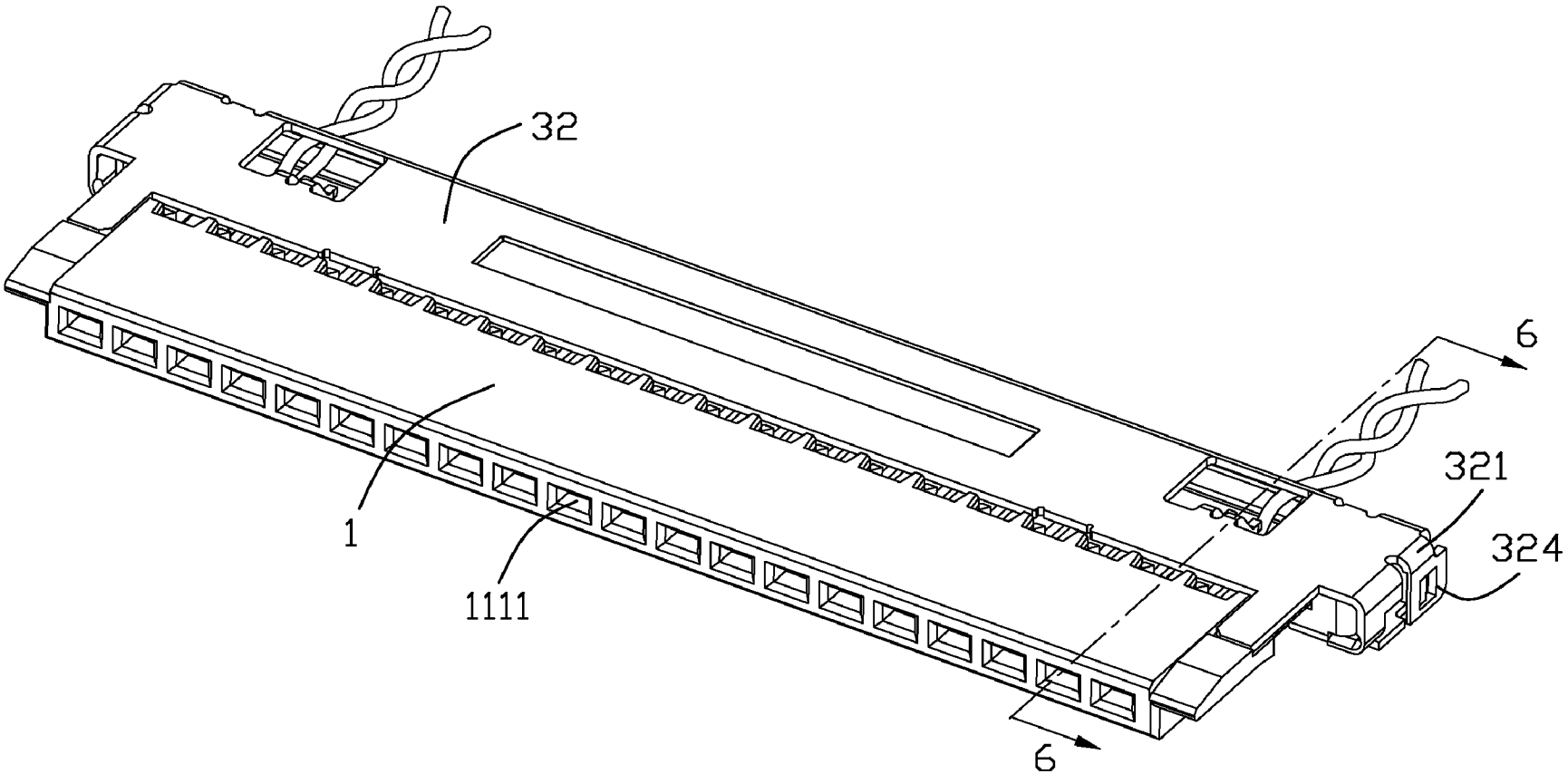
FIG. 1 is a perspective view of a cable assembly in accordance with a preferred embodiment of the present invention.
Figure 2:
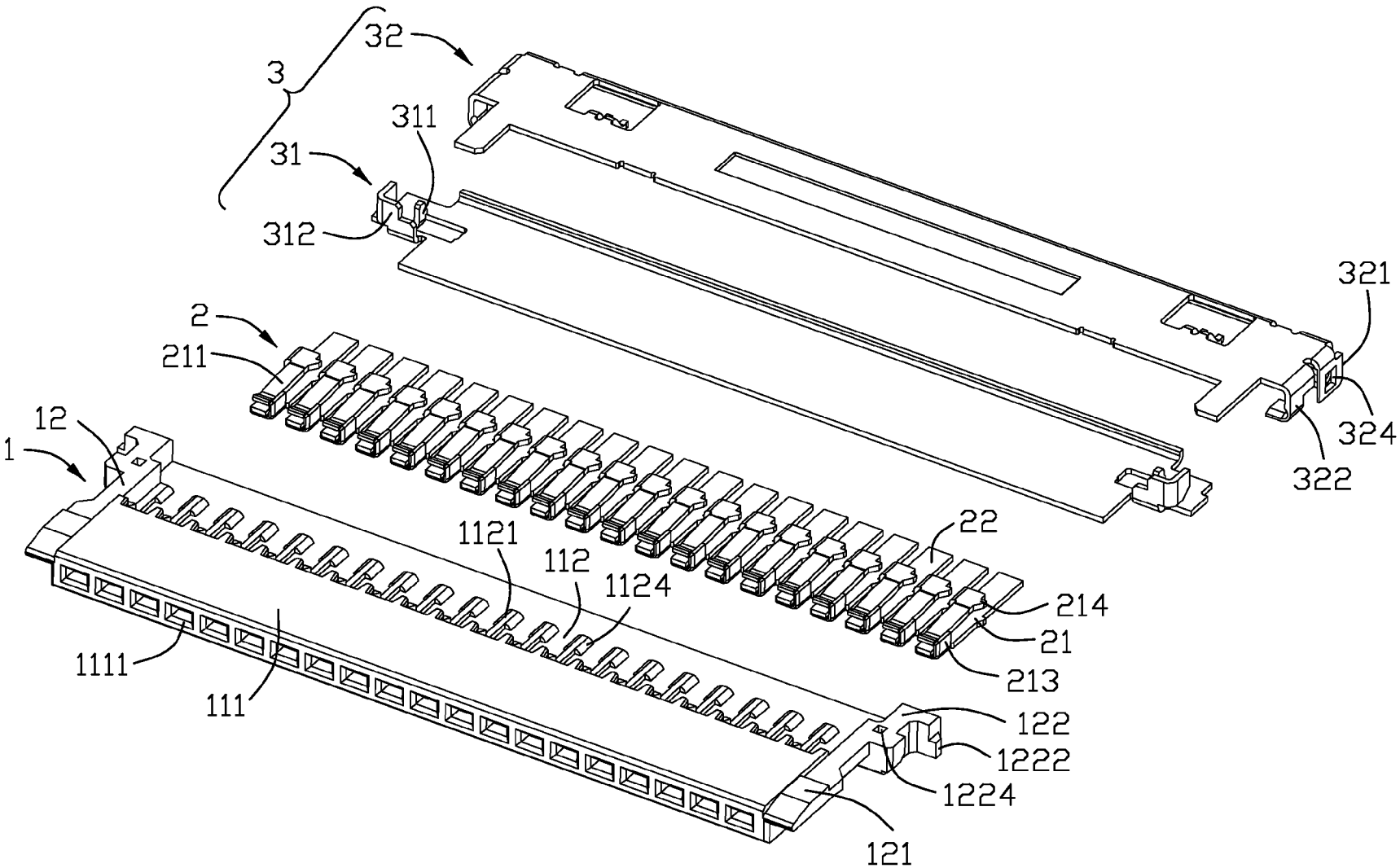
FIG. 2 is an exploded, perspective view of FIG. 1, but from a different aspect.
Figure 3:
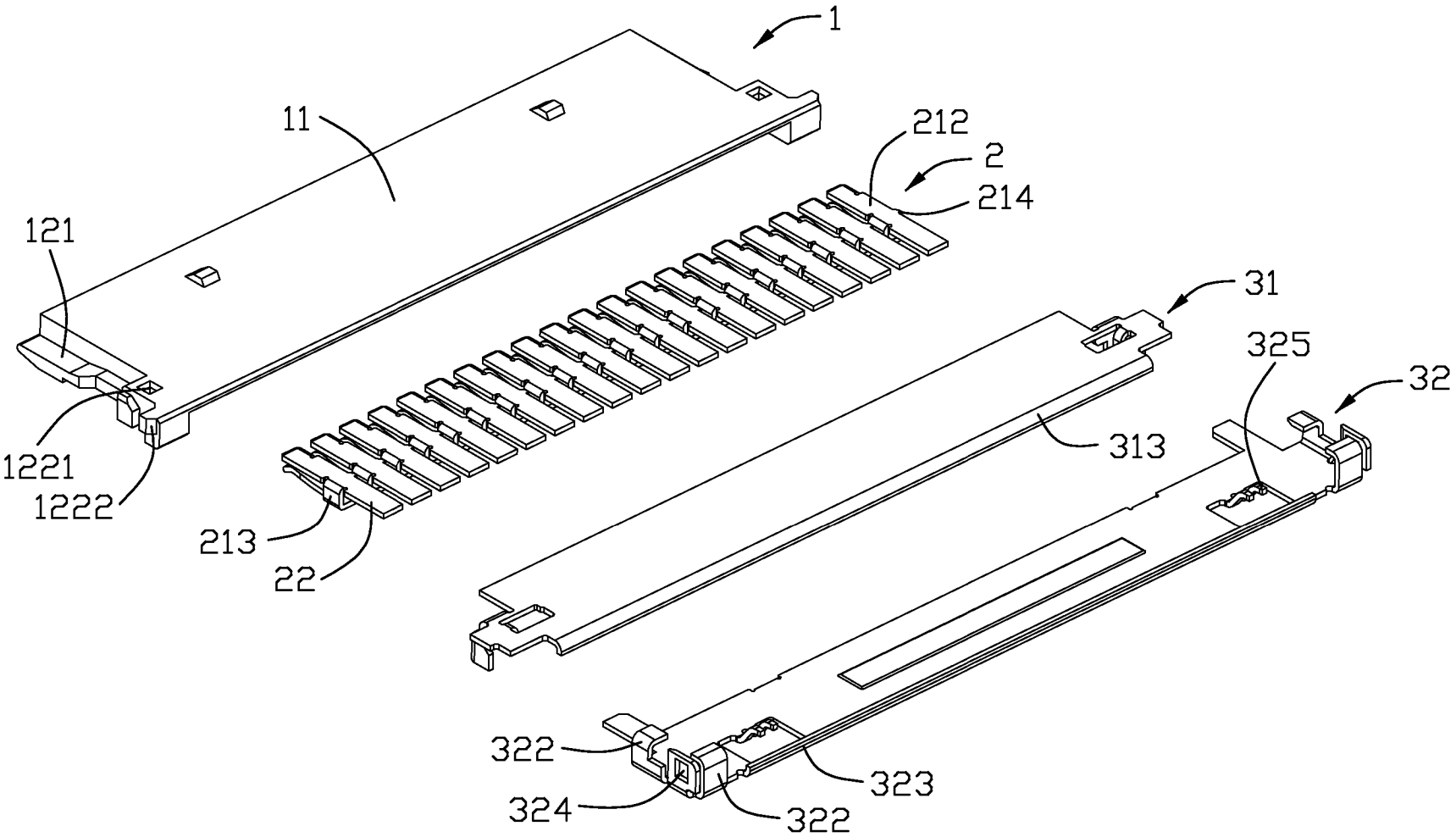
FIG. 3 is a view similar to FIG. 1, but from a different aspect.
Figure 4:
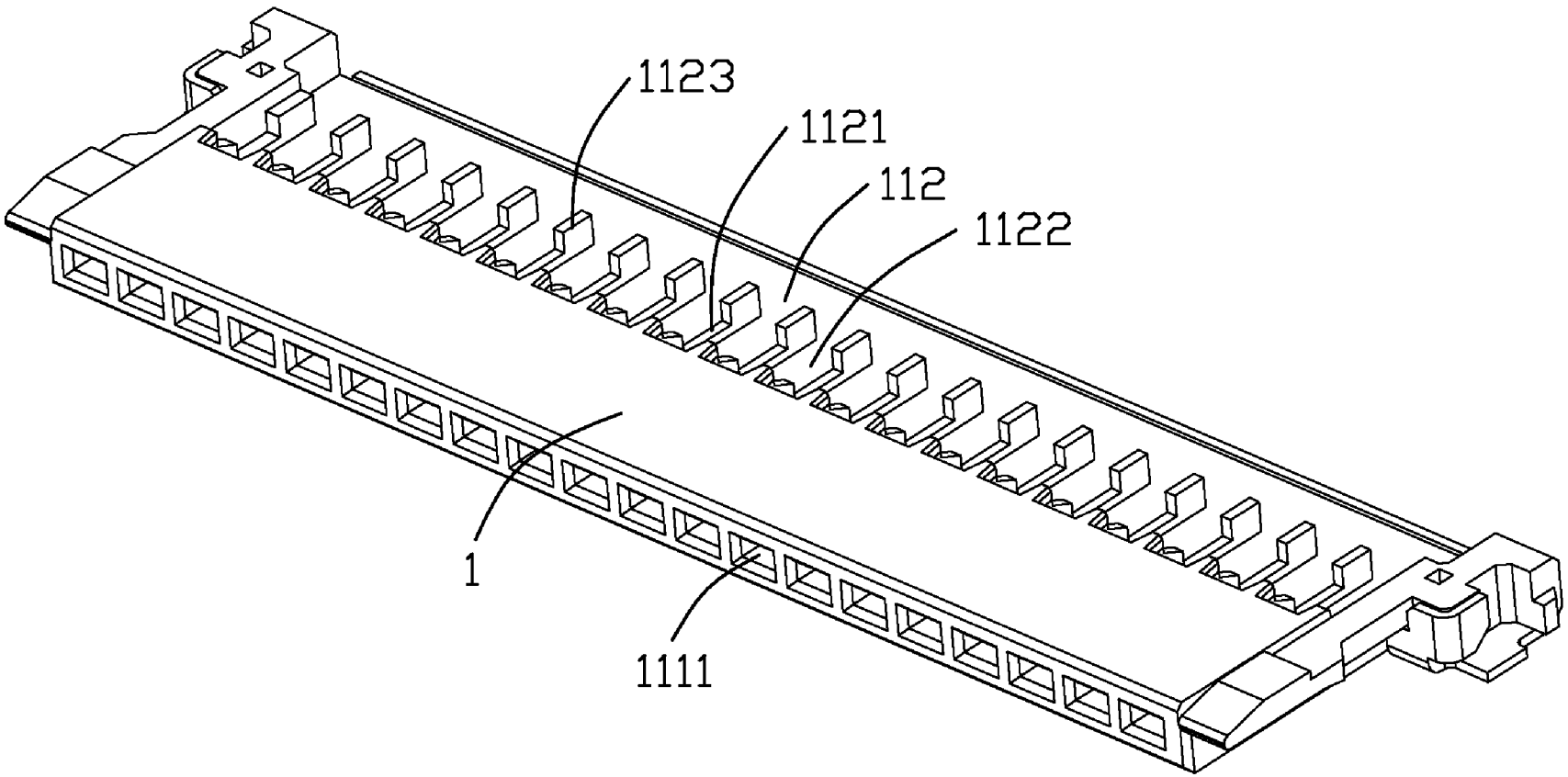
FIG. 4 is a perspective view of a housing of the cable assembly of the present invention before the housing is hot melt.
Figure 5:
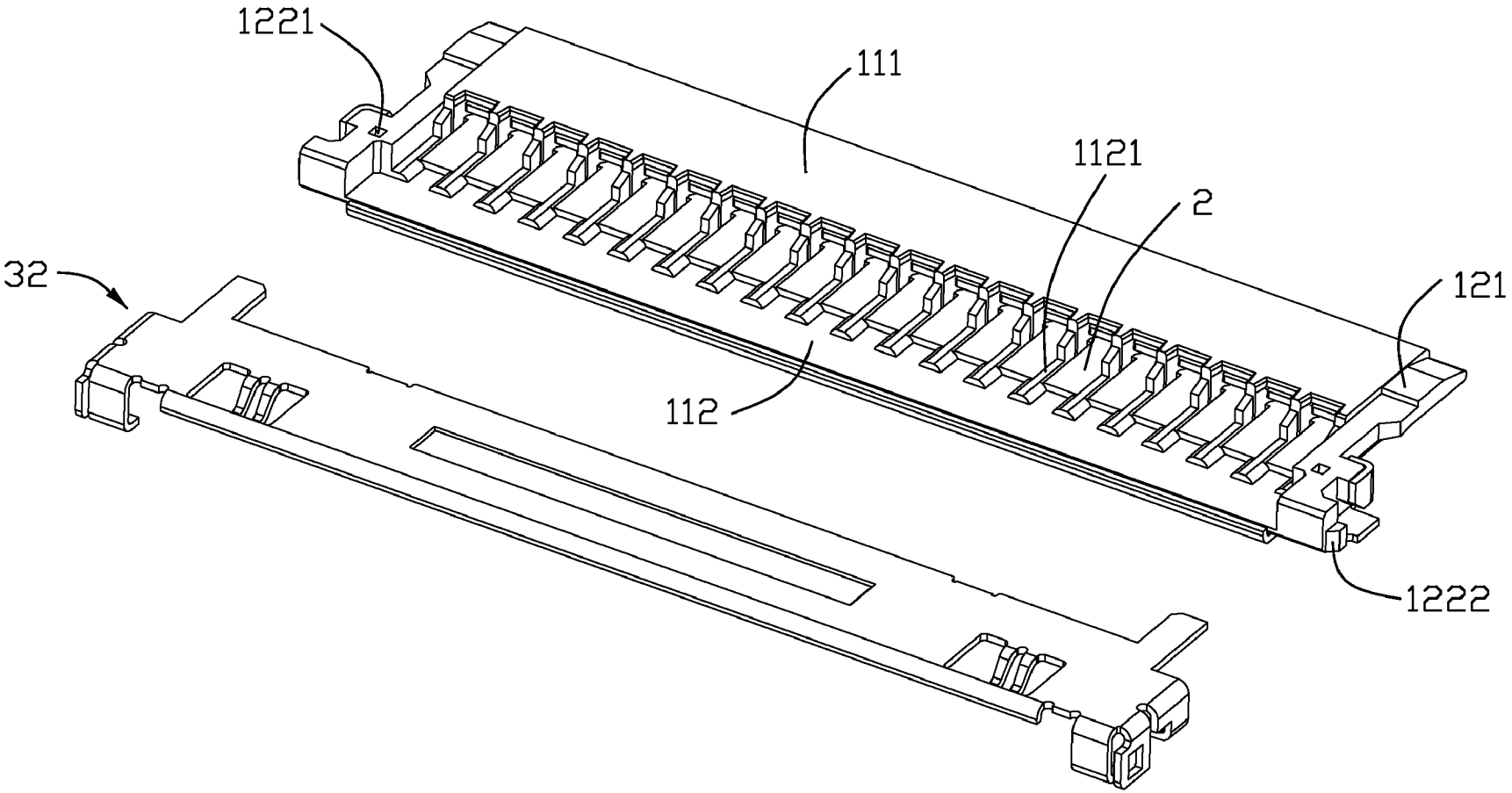
FIG. 5 is a part-assembled perspective view of the cable assembly of the present invention.
Figure 6:
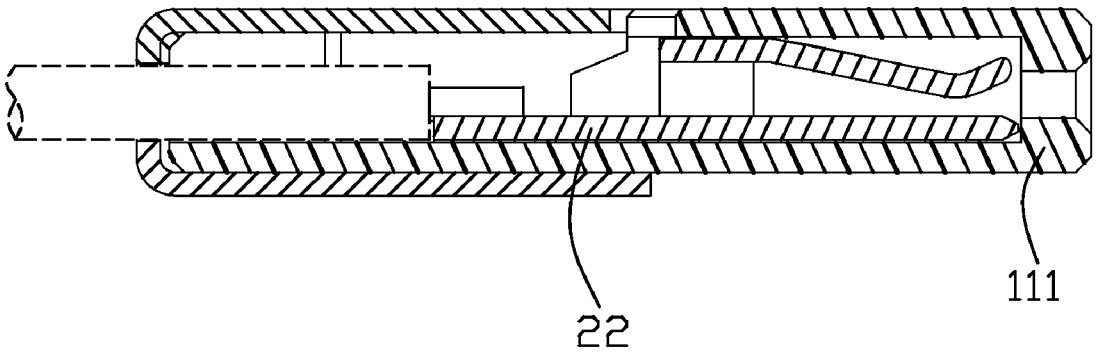
FIG. 6 is a cross-section view of the cable assembly taken along line 6-6 of FIG. 1.

Referring to FIGS. 1 to 6, a cable assembly 100 comprises a housing 1, a plurality of terminals 2 received in the housing

1, a pair of shell 3 covering the housing 1, and a plurality of cables 4 connected to the terminals 2. In this embodiment, each cable 4 is a twisted-pair wire, but in other embodiment, the cable 4 could be another type of cables.

The housing 1 comprises a main body 11, and a pair of side portions 12 extending from the two sides of the main body 11. The main body 11 comprises a mating portion 111 connected to a complementary connector and a supporting portion 112 rearward extending from the mating portion 111. A plurality of receiving passageways 1111 are formed in the mating portion 111 along a front-to-rear direction to respectively extend from a front face to a rear face of the mating portion 111. A plurality of ribs 1121 upward extends from an upper surface of the supporting portion 112 to form a plurality of receiving grooves 1122 which are respectively corresponding to the passageways 1111 in the mating portion 111. Each of the ribs 1121 has a hot-melting pole 1123 (shown in FIG. 4) located on a rear end of the rib 1121. When the hot-melting pole 1123 would be hot melted, the pole 1123 will form a block 1124 extending from the rear end of the rib 1121 into its two sides receiving grooves 1122. The side portions 12 comprises a guiding portion 121 and a pair of fastening portions 122 rearward extending from the two sides of the guiding portion 121. The fastening portion 122 has a fastening aperture 1221 extending through an upper and lower surfaces thereof and a locking portion 1222 extending from the out side surface thereof.

The terminal 2 comprises a mating piece 21 for mating to a terminal of a complementary connector (not shown), and a connecting piece 22 extending from the mating piece 21. The mating piece 21 comprises an upper patch 211, an lower patch 212 spaced apart from the upper patch 211 and parallel to the upper patch 211, a front and rear connecting patch 213 respectively connecting front side edges and rear side edges of the upper and lower patches 211, 212. The upper patch 211 and the lower patch 212 respectively has a stick 214 extending from the rear side edge thereof opposite to the connecting patch 213. The connecting piece 22 rearward extends from a rear edge of the lower patch 212. When one terminal 2 is received in its corresponding receiving groove 1122 of the housing 1, each two blocks 1124 received in the receiving groove 1122 sustain an rear edge of connecting piece 22 of the terminal 2 for prevent the terminal from moving rearward. In other embodiment, the terminals 2 can be of other structures such as I-shaped configuration.

The shell 3 includes a lower shell 31 and an upper shell 32 both which are designed according to the shape of the housing 1 and correspond to each other. The lower shell 31 has a pair of fixing pins 311 upward protruding therefrom, and a pair of L-shape blocking wall 312 upward extending from two sides thereof. A first holding portion 313 upwardly and rearward extends from rear edge of the lower shell 31 to form an arc rim. The upper shell 32 comprises a fastening slice 321 downward extending from two side edges thereof, two pairs of L-shaped holding slices 322 respectively extending two side edges and rear edge thereof, and a second holding portion 323 downward and rearward extending from rear edge thereof. An opening 324 is formed on the fastening slice 321. A plurality of flexible fingers 325 are formed on the upper shell 32 to downward extend from the upper shell 32 for touching cables 4.

In assembly, the terminals 2 are inserted into the housing 1 along a rear-to-front direction with the mating portions 21 respectively received in the passage ways 1111 and the connecting portions 22 respectively received in the receiving grooves 1122. And then, the hot-melting poles 1123 are hot melt to the blocks 1124 for sustaining the rear edges of the connecting portions 22 of the terminals 2. The cables 4 are soldered on the connecting portion 22 of the terminals 2 and extend out of the supporting portion 112 of the housing 1. The lower shell 31 is assembled on the housing 1 along a down-to-up direction through the fixing pins 311 being inserted into and interefentially matched to the fastening aperture 1221. The blocking wall 312 is used to prevent the lower shell 3 from transversally moving. The upper shell 31 is assembled on the housing 1 with the two pairs of L-shaped holding slices 322 respectively holding two sides and rear edge of the housing 1 and the opening 324 of two fastening slices 321 receiving the locking portion 1222 of the housing 1. The first holding portion 313 of the lower shell 31 and the second holding portion 323 of the upper shell 32 are combined to hold the cable 4 therebetween.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An electric connector, comprising: a housing with a plurality of receiving grooves separated by a plurality of ribs; and a plurality of terminals each having a rear edge received in one of the receiving grooves; wherein each of the ribs comprises a pair of wings formed by hot melting a protrusion defined on a tail of the rib, and every two wings received in the same receiving groove block on a rear edge of the terminal.

2. The electric connector as claimed in claim 1, wherein each terminal comprises a mating portion and a connecting portion with the rear edge, said mating portion comprises an upper patch, a lower patch spaced apart from the upper patch and parallel to the upper patch, a front and rear connecting patches respectively connecting the upper and lower patches on opposite corners thereof.

3. The electric connector as claimed in claim 2, wherein the connecting portion is of planar structure.

4. The electric connector as claimed in claim 2, wherein the housing comprises a main body and a supporting portion rearward extending from the main body, said main body comprises a plurality of passageways therein corresponding to the receiving grooves.

5. The electric connector as claimed in claim 4, wherein the mating portions of the terminals are respectively in the passageways and the connecting portions of the terminals are respectively in the receiving grooves.

6. The electric connector as claimed in claim 5, wherein the electric connector further comprises a pair of shells respectively upward and downward assembled on the housing.

7. The electric connector as claimed in claim 6, wherein each shell comprises a holding portion and respective holding portions extend toward each other.

8. The electric connector as claimed in claim 7, wherein the housing further comprises a pair of side portions extending from the main body along two opposite sides, each said side portion comprises a guiding portion, front edges of the two shells are both behind rear edges of the guiding portions.

9. A cable assembly, comprising: a housing with a plurality of receiving grooves separated by a plurality of ribs; a plurality of cables; and a plurality of terminals which each has a connecting portion, fastening the cables, with a rear edge received in one of the receiving grooves of the housing; wherein each of the rib comprises at least one wing formed by hot melting a protrusion defined on a tail of the rib, and said at least one wing received in the same receiving groove blocks on a rear edge of the terminal.

10. The cable assembly as claimed in claim 9, wherein each terminal comprises a mating portion and the connecting portion has the rear edge, said mating portion comprises an upper patch, a lower patch spaced apart from the upper patch and parallel to the upper patch, a front and rear connecting patch respectively connecting the upper and lower patches on opposite corners thereof.

11. The cable assembly as claimed in claim 10, wherein the connecting portion is of planar structure.

12. The cable assembly as claimed in claim 10, wherein the housing comprises a main body and a supporting spacer rearward extending from the main body, said main body comprises a plurality of passageways therein corresponding to the receiving grooves.

13. The cable assembly as claimed in claim 12, wherein the mating portions of the terminals are respectively in the passageways and the connecting portions of the terminals are respectively in the receiving grooves.

14. The cable assembly as claimed in claim 13, wherein the electric connector further comprises a pair of shell respectively upward and downward assembled on the housing.

15. The cable assembly as claimed in claim 14, wherein each shell comprises a holding portion and two holding portion extending toward to each other.

16. The cable assembly as claimed in claim 15, wherein the housing further comprises a pair of side portions extending from the main body along two opposite directions, each said side portion comprises a guiding portion, said front edges of the two shells are both behind rear edges of the guiding portions.

17. The cable assembly as claimed in claim 9, wherein each cable is comprised of twisted-pair wires.

18. A cable connector assembly comprising: an insulative housing defining a plurality of passageways extending there through in a front-to-back direction to respectively communicate opposite mating side and connecting side of the housing; a plurality of contacts horizontally forwardly snugly assembled into the corresponding passageway, respectively; and a plurality of ribs located at a rear side of the corresponding passageways, respectively; wherein each of said ribs originally is not aligned with the corresponding passageway in the front-to-back direction so as not to block forward insertion of the contact into the corresponding passageway during assembling while being permanently deformed with a bumped portion to be aligned with the corresponding passageway in the front-to-back direction and thus block the corresponding passageway in said front-to-back direction so as to prevent rearward withdrawal of the corresponding contact from the corresponding passageway.

19. The cable connector assembly as claimed in claim 18, wherein said bumped portion laterally invades a rear side passage of the corresponding passageway for preventing rearward contact withdrawal.

20. The cable connector assembly as claimed in claim 19, wherein said ribs are aligned, in said front-to-back direction, with partition walls each between every adjacent two passageways.

* * * * *